US006541948B1

(12) United States Patent
Wong

(10) Patent No.: US 6,541,948 B1
(45) Date of Patent: Apr. 1, 2003

(54) VOLTAGE REGULATOR AND METHOD USING HIGH DENSITY INTEGRATED INDUCTORS AND CAPACITORS FOR RADIO FREQUENCY SUPPRESSION

(75) Inventor: Kern W. Wong, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/004,752

(22) Filed: Dec. 4, 2001

(51) Int. Cl.[7] ..... G05F 1/40; G05F 1/44; G05F 1/656

(52) U.S. Cl. ..... 323/284; 323/222; 323/286

(58) Field of Search ..... 323/222, 220, 323/280, 286, 284, 285

(56) References Cited

U.S. PATENT DOCUMENTS 5,355,058 A * 10/1994 Jackson et al. ..... 315/371
5,471,378 A * 11/1995 King ..... 363/46
5,490,055 A * 2/1996 Boylan et al. ..... 363/41
5,786,990 A * 7/1998 Marrero ..... 363/16
5,856,739 A * 1/1999 Trica ..... 323/222
5,912,552 A * 6/1999 Tateishi ..... 323/285
6,144,194 A * 11/2000 Varga ..... 323/285

* cited by examiner

*Primary Examiner*—Bao Q. Vu
(74) *Attorney, Agent, or Firm*—Davis Munck, P.C.

(57) ABSTRACT

A voltage regulator formed on an integrated circuit is provided that includes an amplifier and a feedback circuit. The amplifier is operable to receive a reference voltage and a feedback voltage. The amplifier is also operable to generate a regulated output voltage based on the reference voltage and the feedback voltage. The feedback circuit, which is coupled to the amplifier, is operable to generate the feedback voltage. The feedback circuit includes an inductor-capacitor network. The inductor-capacitor network is operable to remove high frequencies from the output voltage.

20 Claims, 3 Drawing Sheets

VOLTAGE REGULATOR AND METHOD USING HIGH DENSITY INTEGRATED INDUCTORS AND CAPACITORS FOR RADIO FREQUENCY SUPPRESSION

TECHNICAL FIELD OF THE INVENTION

The present invention relates generally to voltage regulation for integrated circuits and, more particularly, to an improved voltage regulator and method using high density integrated inductors and capacitors for radio frequency suppression.

BACKGROUND OF THE INVENTION

Business and consumers use a wide array of wireless devices, including cell phones, wireless local area network (LAN) cards, global positioning system (GPS) devices, electronic organizers equipped with wireless modems, and the like. The increased demand for wireless communication devices has created a corresponding demand for technical improvements to such devices. Generally speaking, more and more of the components of conventional radio receivers and transmitters are being fabricated in a single integrated circuit (IC) package. In order to simplify single chip designs and to make each design suitable for as many applications as possible, much emphasis has been placed on developing on-chip voltage regulators.

Conventional integrated circuits include high frequency oscillators, such as crystal oscillators or voltage-controlled oscillators, which require high stability and low phase noise. Thus, these oscillators generally cannot tolerate noise riding on their supply rails and bias lines. However, the increased integration of components onto a single chip typically results in a noisier environment.

One solution to the problems of excess noise and transient undulation in integrated circuits has been to use bypass capacitors and voltage regulators. Low dropout voltage regulators are used to track out low frequency signals and a bypass capacitor is used to shunt some high frequency components to the rail.

However, bypass capacitors generally cannot redirect an acceptable amount of the high frequency noise, such as radio frequency noise, that is typically associated with communication devices. In addition, because the high frequency components are shunted to the rail by the bypass capacitor, these components may end up as a disturbance elsewhere in the integrated circuit.

One solution to this problem involves the addition of an external inductor. The impedance of the inductor increases at high frequencies, so high frequency noise can be greatly attenuated, blocked or dissipated as heat as it traverses the inductor. However, a problem associated with this solution is that the inductor is typically located at the end of the voltage regulation chain. As a result of this, the DC voltage drop across the inductor could result in large output voltage variation due to load current changes and component tolerance, thereby defeating the original purpose of the voltage regulator.

Another solution to the problem has been to boost up the bandwidth of an error amplifier in the regulator system. However, problems with this solution include increased power consumption, reduced gain, and reduced stability margin. In addition, there is a limit to how much the bandwidth may be boosted. Generally, a gigahertz, or even a hundreds of megahertz, bandwidth amplifier is not feasible in a regulator system. Moreover, having a wider bandwidth amplifier causes the feedback system to execute rapid, nearly constant corrections. Thus, with large input or power supply perturbations, the feedback system may generate noise, may overcorrect or undercorrect, and may consume excessive power.

Other problems with conventional voltage regulators include an inability to provide internal compensation not only due to the load being an unknown parameter, but more importantly because internal compensation (of the error amplifier) often exacerbates power supply rejection ratio problems and makes high frequency suppression performance even worse. Therefore, in order to provide compensation, large and expensive external load capacitors are typically employed as compensation components.

SUMMARY OF THE INVENTION

In accordance with the present invention, an improved voltage regulator and method are provided that substantially eliminate or reduce disadvantages and problems associated with conventional systems and methods. In particular, on-chip inductors are integrated in the feedback loop of a voltage regulator to remove high frequencies without compromising the regulated output level.

According to one embodiment of the present invention, a voltage regulator formed on an integrated circuit is provided. The voltage regulator includes an amplifier and a feedback circuit. The amplifier is operable to receive a reference voltage and a feedback voltage. The amplifier is also operable to generate a regulated output voltage based on the reference voltage and the feedback voltage. The feedback circuit, which is coupled to the amplifier, is operable to generate the feedback voltage. The feedback circuit includes an inductor-capacitor network. The inductor-capacitor network is operable to remove high frequencies from the output voltage.

According to yet another embodiment of the present invention, a method for regulating an output voltage for a voltage regulator formed on an integrated circuit is provided. The method includes providing an output voltage to a feedback circuit. The feedback circuit includes an inductor-capacitor network. High frequencies are removed from the output voltage with the inductor-capacitor network of the feedback circuit. A feedback voltage is generated with the feedback circuit. The feedback voltage is based on the output voltage. The output voltage is regulated based on the feedback voltage.

According to yet another embodiment of the present invention, a method for internally compensating a voltage regulator formed on an integrated circuit is provided. The method includes coupling a feedback circuit to an amplifier. The feedback circuit includes an inductor-capacitor network. The amplifier is operable to regulate an output voltage for the voltage regulator based on a feedback voltage from the feedback circuit. The output voltage is provided to the feedback circuit. Stability of the output voltage is compensated with the inductor-capacitor network of the feedback circuit. The feedback voltage is generated with the feedback circuit based on the output voltage.

Technical advantages of one or more embodiments of the present invention include providing an improved voltage regulator. In a particular embodiment, on-chip inductors are integrated in the feedback loop of a voltage regulator. As a result, high frequencies are removed without compromising the regulated output level. In addition, on-chip capacitors are integrated in the feedback loop, enabling the voltage regulator to be internally compensated. This minimizes cost and board space requirements for the voltage regulator as compared to voltage regulators using large external load capacitors for loop stability.

Other technical advantages will be readily apparent to one skilled in the art from the following figures, description, and claims.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

FIGS. 1 through 4, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged voltage regulator.

Figure 1:
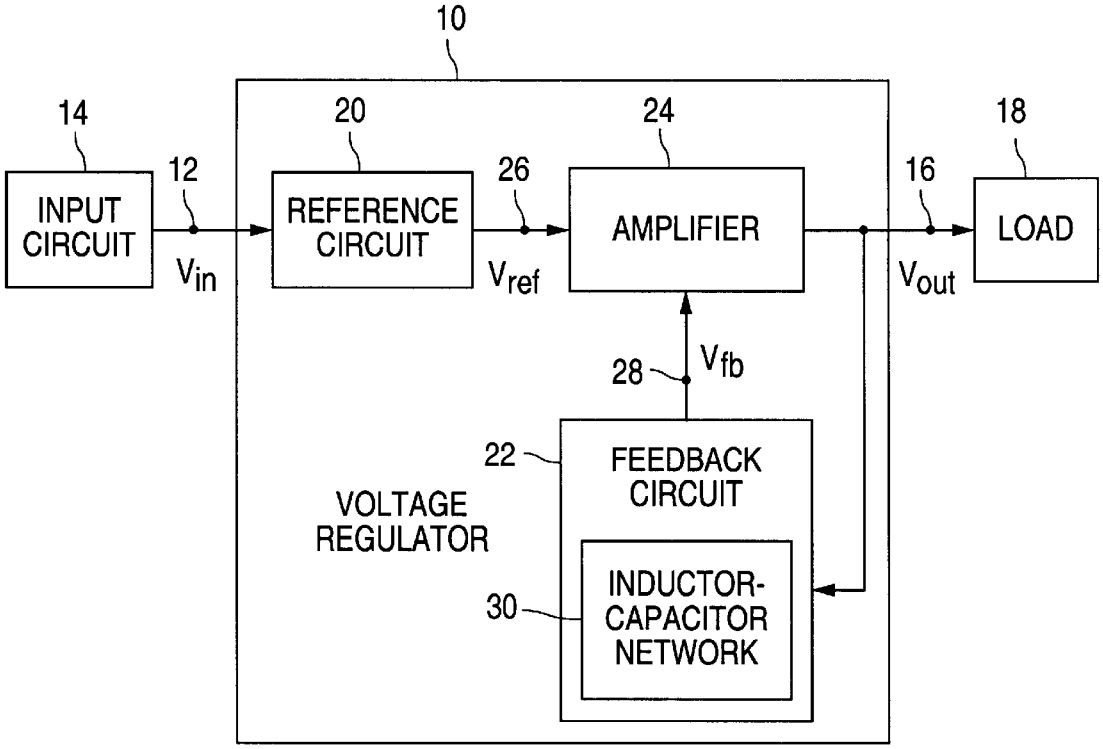
FIG. 1 is a block diagram illustrating a voltage regulator in accordance with one embodiment of the present invention.

FIG. 1 is a block diagram illustrating a voltage regulator 10 in accordance with one embodiment of the present invention. The voltage regulator 10 is operable to receive a varying input voltage 12 from an input circuit 14 and to generate a relatively constant output voltage 16 for a load 18.

The voltage regulator 10 may be a component in a phase-locked loop, a voltage-controlled oscillator, or any other suitable circuit in a radio circuitry device, a remote-controlled device, or any other device using voltage regulation. For example, the voltage regulator 10 may be a component in a laptop computer, a cellular telephone, a pager, or any other suitable communication device.

In accordance with one embodiment of the present invention, the input circuit 14 may comprise a power supply that is operable to provide an input voltage 12 that may vary within a specified range of voltages. The load 18 may comprise one or more components that are operable to receive the output voltage 16.

The output voltage 16 generated by the voltage regulator 10 may comprise a relatively constant voltage, i.e., the output voltage 16 may vary within a significantly reduced range as compared to the input voltage 12. Thus, the output voltage 16 is regulated to be close to a desired voltage level regardless of the input voltage 12 when the input voltage 12 is within the specified range.

According to one embodiment, the voltage regulator 10 comprises a low dropout voltage regulator. For this embodiment, the voltage regulator 10 may be operable to regulate the output voltage 16 based on an input voltage 12 as low as 100 mV higher than the desired output voltage 16.

For example, according to one embodiment, the input voltage 12 may vary from about 2.6 to about 2.8 volts, while the output voltage 16 varies from about 2.38 to about 2.42 volts. However, it will be understood that the ranges of voltages for input voltage 12 and output voltage 16 may comprise any other suitable values without departing from the scope of the present invention.

The voltage regulator 10 comprises a reference circuit 20, a feedback circuit 22, and an amplifier 24. The reference circuit 20 is coupled to the input circuit 14 and is operable to receive the input voltage 12 and to generate a reference voltage 26 based on the input voltage 12. The feedback circuit 22 is operable to receive the output voltage 16 and to generate a feedback voltage 28 based on the output voltage 16. The amplifier 24 is coupled to the reference circuit 20 and to the feedback circuit 22. The amplifier 24 is operable to receive the reference voltage 26 and the feedback voltage 28 and to regulate the output voltage 16 based on the reference voltage 26 and the feedback voltage 28.

The feedback circuit 22 comprises an integrated inductor-capacitor network 30. The inductor-capacitor network 30 comprises at least one inductor and at least one capacitor. The inductor-capacitor network 30 is operable to remove high frequencies from the output voltage 16 generated by the voltage regulator 10 with the inductor and to provide internal compensation to stabilize the voltage regulator 10 with the capacitor. According to one embodiment, high frequencies comprise frequencies of about 1 MHz to about 10 GHz or higher. In a particular embodiment, the inductor-capacitor network 30 is operable to remove frequencies of about 800 MHz to about 5 GHz.

In accordance with one embodiment of the present invention, the voltage regulator 10, including the inductor-capacitor network 30 of the feedback circuit 22, is formed on an integrated circuit. For this embodiment, the output voltage 16 may be directly coupled to the load 18. As used herein, "directly coupled" means coupled without external compensation components, such as capacitors and the like, between the output voltage 16 generated by the on-chip voltage regulator 10 and the external load 18. However, although no external compensation components are needed, it will be understood that any suitable components, including external compensation components, may be included between the output voltage 16 and the load 18 without departing from the scope of the present invention.

In operation, the reference circuit 20 receives the input voltage 12 from the input circuit 14. The reference circuit 20 generates the reference voltage 26 based on the input voltage 12 and provides the reference voltage 26 to the amplifier 24. The amplifier 24 regulates the output voltage 16 for the load 18 based on the reference voltage 26.

In addition, the feedback circuit 22 receives the output voltage 16, removes high frequencies from the output voltage 16 with the inductor-capacitor network 30, and generates the feedback voltage 28 based on the output voltage 16. The feedback circuit 22 provides the feedback voltage 28 to the amplifier 24. The amplifier 24 regulates the output voltage 16 based on the feedback voltage 28, in addition to the reference voltage 26.

Figure 2:
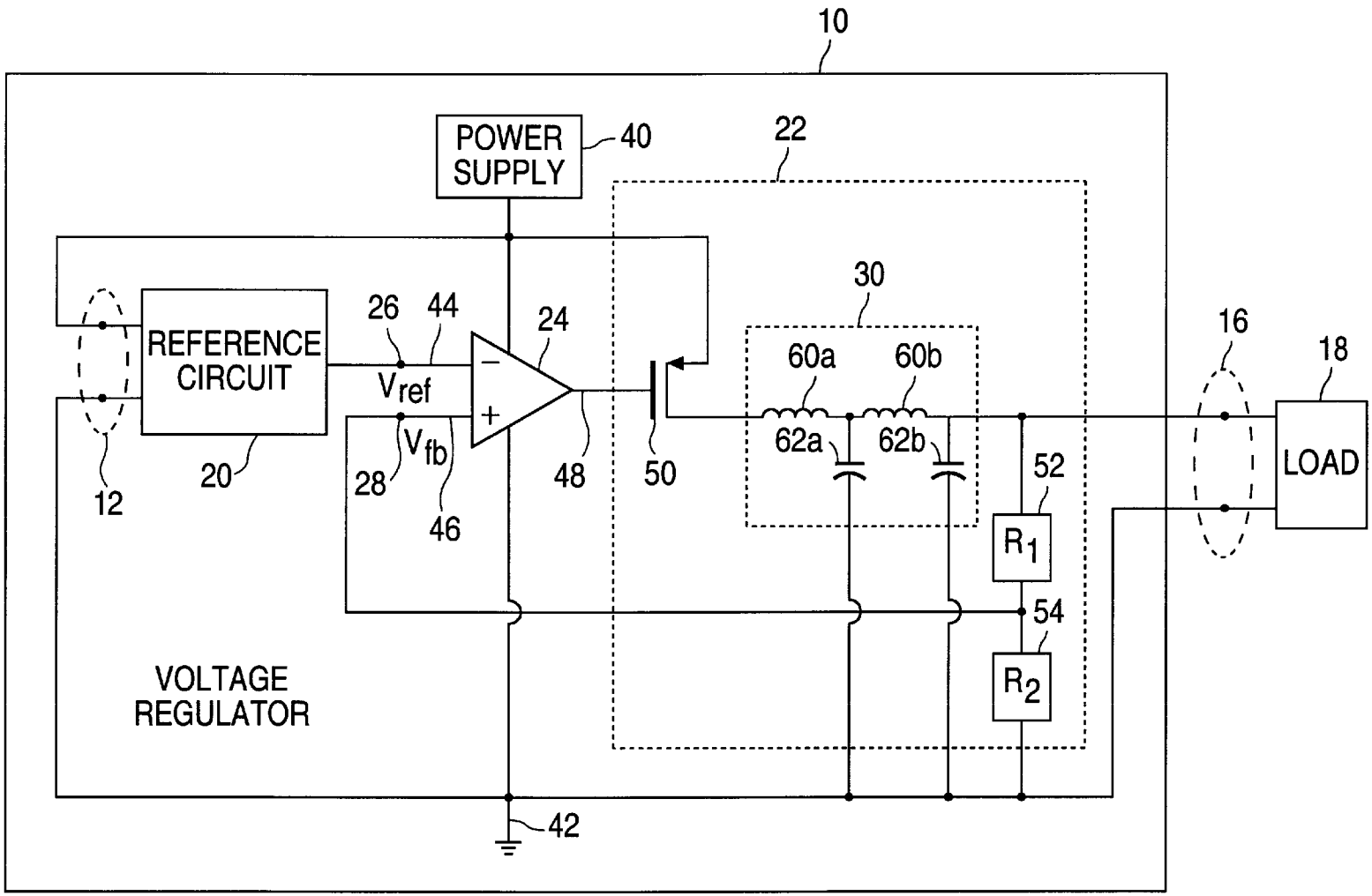
FIG. 2 is a circuit diagram illustrating the voltage regulator of FIG. 1 in accordance with one embodiment of the present invention.

FIG. 2 is a circuit diagram illustrating the voltage regulator 10 in accordance with one embodiment of the present invention. According to this embodiment, the input circuit 14 (not explicitly shown in FIG. 2) is provided by a power supply 40 and a ground 42. The power supply 40 is operable to provide the varying input voltage 12 with respect to ground 42.

According to one embodiment, the power supply 40 is operable to provide about 2.6 to about 2.8 volts, while the ground 42 is operable to provide about 0 volts. However, it will be understood that the power supply 40 may provide any suitable power supply potential, and the ground 42 may provide any suitable potential less than the potential provided by the power supply 40.

The power supply 40 is also operable to provide power to the feedback circuit 22 and the amplifier 24. In addition, the ground 42 is operable to provide the ground potential to the feedback circuit 22, the amplifier 24, and the output voltage 16.

According to the illustrated embodiment, the amplifier 24 comprises an operational amplifier, which comprises an inverting input terminal 44, a non-inverting input terminal 46 and an output terminal 48. The inverting input terminal 44 is coupled to the reference circuit 20 and, thus, is operable to receive the reference voltage 26. The non-inverting input terminal 46 is coupled to the feedback circuit 22 and, thus, is operable to receive the feedback voltage 28. The output terminal 48 is coupled to the feedback circuit 22 and, through the feedback circuit 22, to the load 18. The output terminal 48 is operable to generate the regulated output voltage 16.

According to the illustrated embodiment, the feedback circuit 22 comprises a p-channel metal-oxide semiconductor field-effect transistor (MOSFET) 50 and two resistances 52 and 54, in addition to the inductor-capacitor network 30. The source of the MOSFET 50 is coupled to the power supply 40, the gate is coupled to the output terminal 48 of the amplifier 24, and the drain is coupled to the inductor-capacitor network 30.

Each of the resistances 52 and 54 may comprise a resistor and/or any other suitable component or components operable to provide a specified amount of resistance. As used herein, "each" means every one of at least a subset of the identified items. The feedback voltage 28 is generated between the two resistances 52 and 54.

According to one embodiment, resistance 52 provides about 10 kΩ of resistance, and resistance 54 provides about 10 kΩ of resistance. However, it will be understood that the resistances 52 and 54 may each provide any suitable amount of resistance without departing from the scope of the present invention.

The inductor-capacitor network 30 comprises at least one inductor 60 and at least one capacitor 62. According to one embodiment, the inductor-capacitor network 30 comprises two inductors 60*a* and 60*b* coupled to the drain of the MOSFET 50 in series with each other and two capacitors 62*a* and 62*b* in parallel with each other, with each capacitor 62 coupled to one end of an inductor 60 and coupled to ground 42. However, it will be understood that the inductor-capacitor network 30 may comprise any suitable number of inductors 60 and capacitors 62 without departing from the scope of the present invention.

According to one embodiment, the inductor-capacitor network 30 is operable to remove frequencies up to about 10 GHz or higher. For a particular embodiment, the inductor-capacitor network 30 is operable to remove frequencies between about 800 MHz and about 5 GHz. For this embodiment, the inductors 60 may each comprise about 5 nH of inductance, with a corresponding effective resistance of about 5Ω, and the capacitors 62 may each comprise about 60 pF of capacitance. However, it will be understood that the inductors 60 may each provide any suitable amount of inductance and the capacitors 62 may each provide any suitable amount of capacitance without departing from the scope of the present invention.

According to one embodiment, each inductor 60 comprises polygonal metal tracks on each of five metal layers, with the tracks coupled in series through vias and contacts. In addition, a substrate contact ring and other guard rings may be used around inductor 60*a* for isolation purposes, while inductor 60*b* may be formed without a substrate contact ring or other guard rings. In this way, inductor 60*a* may provide filtering for lower frequency operation, and inductor 60*b* may provide filtering for higher frequency operation. However, it will be understood that the inductors 60 may comprise any suitable structure without departing from the scope of the present invention.

As described in more detail below in connection with FIGS. 3A–B, capacitor 62*a* may comprise an accumulation MOS capacitor enclosed in an N-well, i.e., tied to ground 42, and may be formed with substrate taps around the N-well. In addition, capacitor 62*b* may comprise a capacitor that is formed without substrate taps. For example, the capacitor 62*b* may comprise a metal comb capacitor, a metal-polysilicon capacitor, or a parallel-plate capacitor. In this way, capacitor 62*a* may provide better performance for lower frequency operation, and capacitor 62*b* may provide better performance for higher frequency operation. However, it will be understood that the capacitors 62 may comprise any suitable structure without departing from the scope of the present invention.

In accordance with one embodiment, the amplifier 24 may comprise a compensation capacitor in order to reduce the total amount of compensation capacitance for the voltage regulator 10. For this embodiment, the capacitance provided by the inductor-capacitor network 30 may be reduced as compared to the capacitance provided by the inductor-capacitor network 30 in the absence of a compensation capacitor in the amplifier 24. Alternatively, the inductor-capacitor network 30 may provide the same amount of capacitance, and yet a greater amount of compensation capacitance may be provided for the voltage regulator 10 through the use of a compensation capacitor in the amplifier 24.

In operation, the input voltage 12 is provided to the reference circuit 20 by the power supply 40 and the ground 42. In addition, the power supply 40 and the ground 42 provide power to the amplifier 24 and to the feedback circuit 22.

The reference circuit 20 generates the reference voltage 26 based on the input voltage 12 and provides the reference voltage 26 to the inverting input terminal 44 of the amplifier 24. The amplifier 24 also receives the feedback voltage 28 from the feedback circuit 22 at the non-inverting input terminal 46 of the amplifier 24. The amplifier 24 amplifies the difference between the reference voltage 26 and the feedback voltage 28 and regulates the output voltage 16 based on this amplified difference, which is provided at the output terminal 48 of the amplifier 24 as an amplifier output signal.

The gate of the MOSFET 50 in the feedback circuit 22 receives the amplifier output signal from the output terminal 48 of the amplifier 24. The source of the MOSFET 50 receives power from the power supply 40. The drain of the MOSFET 50 provides a signal to the inductor-capacitor network 30 based on the amplifier output signal received at the gate of the MOSFET 50.

The inductor-capacitor network 30 removes high frequencies from the output voltage 16. The output from the inductor-capacitor network 30, which corresponds to the output voltage 16 with the high frequencies removed, is provided to the resistances 52 and 54, which function as a voltage divider to generate the feedback voltage 28 based on the output voltage 16.

The feedback circuit 22 provides the feedback voltage 28 to the non-inverting input terminal 46 of the amplifier 24. The amplifier 24 continues to regulate the output voltage 16 based on the feedback voltage 28, in addition to the reference voltage 26, as previously described.

Figure 3A:
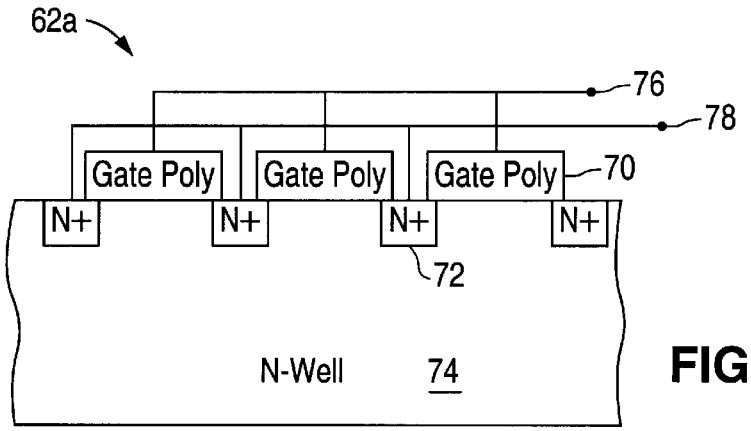
FIGS. 3A–B are schematic cross-sectional diagrams illustrating the capacitors of FIG. 2 in accordance with one embodiment of the present invention.
Figure 3B:
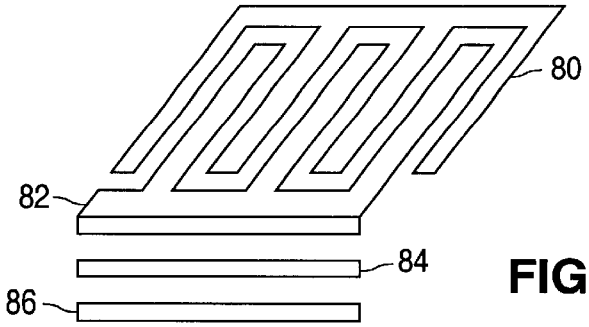

FIGS. 3A–B are schematic cross-sectional diagrams illustrating the capacitors 62 in accordance with one embodiment of the present invention. FIG. 3A illustrates one embodiment of capacitor 62*a*. For this embodiment, capacitor 62*a* comprises an x-finger, N-well accumulation MOS capacitor, with x=1, 8, 20, 40, or other suitable number.

Capacitor 62*a* comprises a specified number, x, of gate fingers 70 and $N^+$ contacts 72 to an N-well 74. The gate fingers 70 are tied together to form a first electrode 76 for capacitor 62*a,* and the $N^+$ contacts 72 to the N-well 74 are tied together to form the second electrode 78 for capacitor 62*a.* Thus, capacitor 62*a* is formed with substrate taps around the N-well 74. Capacitor 62*a* is operable to provide better performance for lower frequency operation as compared to capacitor 62*b*.

FIG. 3B illustrates several embodiments of capacitor 62*b*. For these embodiments, capacitor 62*b* is formed without substrate taps. In addition, capacitor 62*b* is operable to provide better performance for higher frequency operation as compared to capacitor 62*a*.

FIG. 3B illustrates three different types of capacitors which may be used to form capacitor 62*b* as a high density component of an integrated circuit. A first metal comb capacitor may be formed by the fringes at the edges of metal comb 80 and metal comb 82, which are formed on a same plane. A second, metal-polysilicon capacitor may be formed by a polysilicon layer 84 and a metal layer 86 on different planes. A third, parallel-plate capacitor may be formed by metals on different planes, such as metal combs 80 and 82 in conjunction with metal layer 86. Using high density capacitors formed in this way, the inductor-capacitor network 30 may be integrated into the voltage regulator relatively easily.

Figure 4:
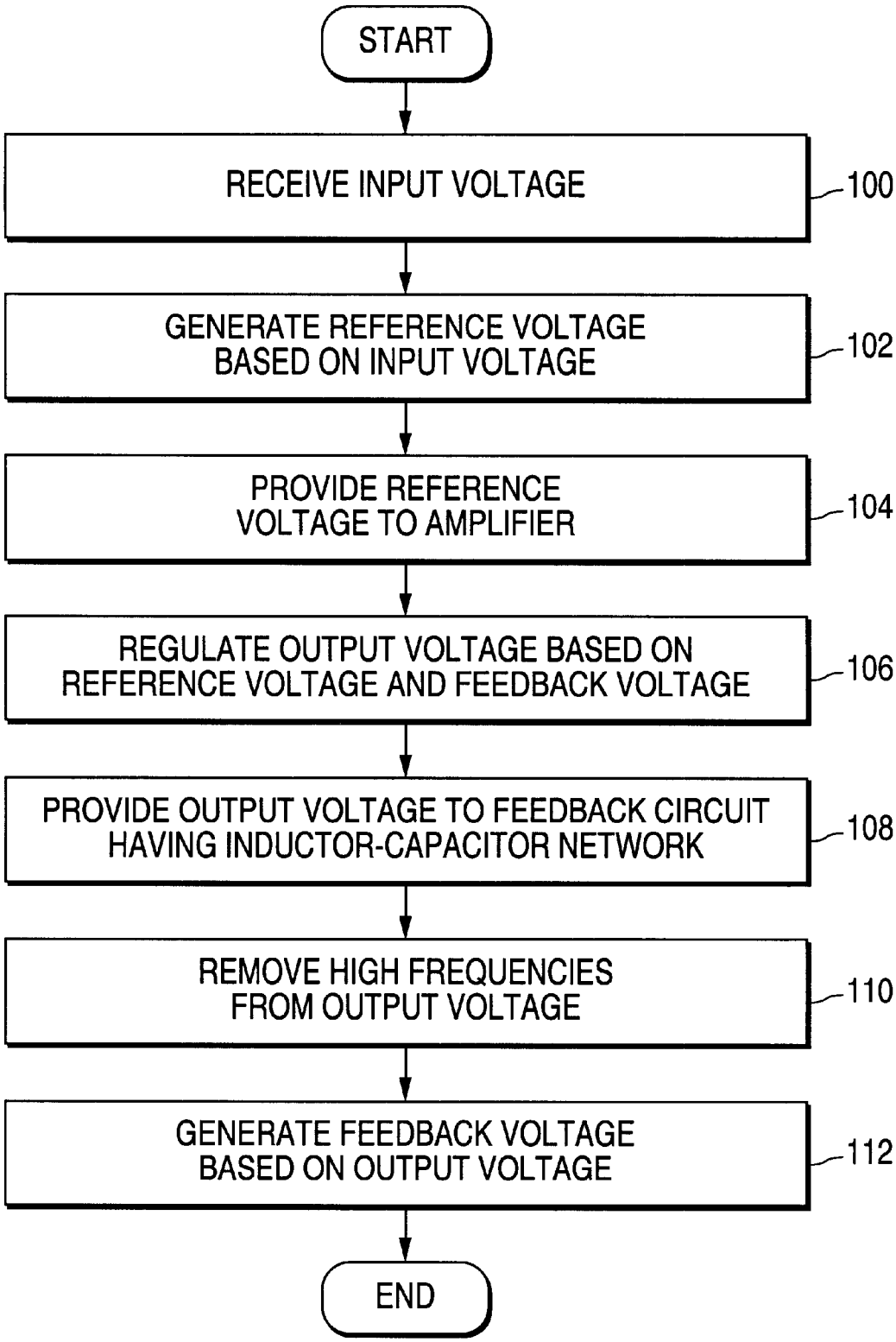
FIG. 4 is a flow diagram illustrating a method for regulating voltage using the voltage regulator of FIG. 1 in accordance with one embodiment of the present invention.

FIG. 4 is a flow diagram illustrating a method for regulating voltage using the voltage regulator 10 in accordance with one embodiment of the present invention. The method begins at step 100 where the voltage regulator 10 receives an input voltage 12 at a reference circuit 20.

At step 102, the reference circuit 20 generates a reference voltage 26 based on the input voltage 12. At step 104, the reference circuit 20 provides the reference voltage 26 to an amplifier 24 in the voltage regulator 10. At step 106, the amplifier 24 regulates an output voltage 16 based on the reference voltage 26 and on a feedback voltage 28 from a feedback circuit 22. At step 108, the output voltage 16 is provided to the feedback circuit 22, which comprises an inductor-capacitor network 30.

At step 110, the inductor-capacitor network 30 removes high frequencies from the output voltage 16. According to one embodiment, the inductor-capacitor network 30 may remove frequencies of about 1 MHz to about 10 GHz or higher. In a particular embodiment, the inductor-capacitor network 30 removes frequencies of about 800 MHz to about 5 GHz. At step 112, the feedback circuit 22 generates the feedback voltage 28 for the amplifier 24 based on the output voltage 16 without the high frequencies which were removed by the inductor-capacitor network 30, at which point the method comes to an end.

In this way, any DC voltage variation resulting from variation of output current or tolerance of the DC resistance of the inductors 60 is compensated by the feedback circuit 22, thereby stabilizing the DC output voltage 16 and significantly improving the performance of high frequency noise suppression by the voltage regulator 10. Also, as result of this improvement, internal compensation is provided. Thus, stability of the output voltage 16 is compensated with the capacitors 62, which minimizes the cost and board space requirements that are associated with using large external load capacitors for loop stability. In addition, a compensation capacitor may be employed in the amplifier 24, thereby reducing the total amount of compensation capacitance for the voltage regulator 10. This results in a further reduction in die area and design cost.

Although the present invention has been described with several embodiments, various changes and modifications may be suggested to one skilled in the art. It is intended that the present invention encompass such changes and modifications as fall within the scope of the appended claims.

What is claimed is:

1. A voltage regulator formed on an integrated circuit, comprising:

an amplifier operable to receive a reference voltage and a feedback voltage and to generate a regulated output voltage based on the reference voltage and the feedback voltage; and a feedback circuit coupled to the amplifier, the feedback circuit operable to generate the feedback voltage, the feedback circuit comprising an inductor-capacitor network, the inductor-capacitor network operable to remove high frequencies from the output voltage.

2. The voltage regulator of claim 1, the inductor-capacitor network comprising at least two inductors and at least two capacitors.

3. The voltage regulator of claim 2, the inductor-capacitor network comprising a first inductor with guard rings and a second inductor without guard rings.

4. The voltage regulator of claim 2, the inductor-capacitor network comprising a first capacitor enclosed in an N-well with substrate taps around the N-well and a second capacitor without substrate taps.

5. The voltage regulator of claim 1, further comprising:

an input circuit operable to generate an input voltage; and a reference circuit coupled to the input circuit and to the amplifier, the reference circuit operable to receive the input voltage and to generate the reference voltage based on the input voltage.

6. The voltage regulator of claim 1, high frequencies comprising frequencies of about 1 MHz to about 10 GHz.

7. The voltage regulator of claim 1, high frequencies comprising frequencies of about 800 MHz to about 5 GHz.

8. A method for regulating an output voltage for a voltage regulator formed on an integrated circuit, comprising:

providing an output voltage to a feedback circuit, the feedback circuit comprising an inductor-capacitor network;

removing high frequencies from the output voltage with the inductor-capacitor network of the feedback circuit;

generating a feedback voltage with the feedback circuit, the feedback voltage based on the output voltage; and regulating the output voltage based on the feedback voltage.

9. The method of claim 8, the inductor-capacitor network comprising at least two inductors and at least two capacitors.

10. The method of claim 9, the inductor-capacitor network comprising a first inductor with guard rings and a second inductor without guard rings.

11. The method of claim 9, the inductor-capacitor network comprising a first capacitor enclosed in an N-well with substrate taps around the N-well and a second capacitor without substrate taps.

12. The method of claim 8, the feedback circuit further comprising a voltage divider, the voltage divider coupled to the inductor-capacitor network, and generating a feedback voltage based on the output voltage comprising generating the feedback voltage with the voltage divider.

13. The method of claim 8, high frequencies comprising frequencies of about 1 MHz to about 10 GHz.

14. The method of claim 8, high frequencies comprising frequencies of about 800 MHz to about 5 GHz.

15. A method for internally compensating a voltage regulator formed on an integrated circuit, comprising:

coupling a feedback circuit comprising an inductor-capacitor network to an amplifier, the amplifier operable to regulate an output voltage for the voltage regulator based on a feedback voltage from the feedback circuit;

providing the output voltage to the feedback circuit;

compensating stability of the output voltage with the inductor-capacitor network of the feedback circuit; and generating the feedback voltage with the feedback circuit based on the output voltage.

16. The method of claim 15, the inductor-capacitor network comprising at least two inductors and at least two capacitors.

17. The method of claim 16, the inductor-capacitor network comprising a first inductor with guard rings and a second inductor without guard rings.

18. The method of claim 16, the inductor-capacitor network comprising a first capacitor enclosed in an N-well with substrate taps around the N-well and a second capacitor without substrate taps.

19. The method of claim 15, further comprising removing frequencies of about 1 MHz to about 10 GHz from the output voltage with the inductor-capacitor network.

20. The method of claim 15, further comprising removing frequencies of about 800 MHz to about 5 GHz from the output voltage with the inductor-capacitor network.

* * * * *